US012049800B2

(12) United States Patent
Garcia et al.

(10) Patent No.: US 12,049,800 B2
(45) Date of Patent: Jul. 30, 2024

(54) SYSTEM AND METHOD FOR A SECONDARY PRESSURE BOUNDARY TOOL

(71) Applicant: Baker Hughes Oilfield Operations LLC, Houston, TX (US)

(72) Inventors: Javier Garcia, Houston, TX (US); Mahesha Udipi, Houston, TX (US); Guy Mitelman, Houston, TX (US); Brian Munk, Houston, TX (US); Keith M. Adams, Katy, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 149 days.

(21) Appl. No.: 17/752,444

(22) Filed: May 24, 2022

(65) Prior Publication Data

US 2023/0383619 A1 Nov. 30, 2023

(51) Int. Cl.
*E21B 34/02* (2006.01)
*E21B 33/068* (2006.01)

(52) U.S. Cl.
CPC ..... *E21B 34/02* (2013.01); *E21B 33/068* (2013.01)

(58) Field of Classification Search
CPC ..... E21B 34/02; E21B 33/068
See application file for complete search history.

(56) References Cited

U.S. PATENT DOCUMENTS 2,077,507 A * 4/1937 Yancey ..... E21B 34/02 166/85.1
2,141,274 A * 12/1938 Lenhart ..... E21B 34/02 29/213.1
2,250,244 A * 7/1941 Yancey ..... E21B 33/068 29/213.1
2,865,530 A * 12/1958 Gould ..... E21B 33/08 251/351
5,020,590 A 6/1991 Mcleod
8,272,443 B2 9/2012 Watson et al.
(Continued)

FOREIGN PATENT DOCUMENTS

CN 107806334 A 3/2018
CN 214787270 U 11/2021
(Continued)

OTHER PUBLICATIONS

James E. Chitwood, "A second generation of subsea maintenance tools," Oct. 24, 1978, SPE European Petroleum Conference, London, United Kingdom, 6 pages, abstract and introduction only.
(Continued)

*Primary Examiner* — Giovanna Wright
(74) *Attorney, Agent, or Firm* — Baker Hughes Company

(57) ABSTRACT

A system includes a Christmas tree (XT) having at least one valve, the XT being coupled to a wellbore. The system also includes a pressure boundary tool adapted to provide a secondary boundary for the XT. The pressure boundary tool includes a plug body to be positioned against a valve member of the at least one valve; a seal to be energized into a valve body of the at least one valve; and a plate arranged proximate the seal, the plate being moveable between a first position and a second position, the first position energizing the seal and a second position deenergizing the seal. The pressure boundary tool is positioned within the XT on a side of the valve member closer to the wellbore.

20 Claims, 16 Drawing Sheets

(56) References Cited

U.S. PATENT DOCUMENTS

| | | | |
|---|---|---|---|
| 9,133,684 | B2 | 9/2015 | Hofman et al. |
| 9,279,310 | B2 | 3/2016 | Howell et al. |
| 10,267,111 | B2 | 4/2019 | Hart et al. |
| 2018/0106128 | A1 | 4/2018 | Nguyen et al. |
| 2019/0360292 | A1 | 11/2019 | Boyd et al. |
| 2021/0317723 | A1 | 10/2021 | Wardley et al. |

FOREIGN PATENT DOCUMENTS

| | | | |
|---|---|---|---|
| WO | 2016/067056 | | 5/2016 |
| WO | 2018000075 | A1 | 1/2018 |

OTHER PUBLICATIONS

International Search Report and Written Opinion issued Sep. 1, 2023 in PCT Application No. PCT/US2023/022698.

* cited by examiner

SYSTEM AND METHOD FOR A SECONDARY PRESSURE BOUNDARY TOOL

BACKGROUND

1. Field of the Disclosure

The present disclosure relates to pressure control tools. Specifically, the present disclosure relates to systems and methods for setting a secondary pressure boundary tool for a downhole application.

2. Description of Related Art

Hydrocarbon exploration may be conducted at surface or offshore locations and may include various pressure boundaries between a formation and an access location. Often, a tree, which may be referred to as a Christmas tree (XT), is arranged at the access location and includes a series of valves that may work with additional vales associated with the wellbore, such as downhole valves. Servicing these valves may include blocking in one or more downhole valves in order to create a sufficient number of pressure boundaries between the wellbore and the access location. Operations associated with downhole valves may be time consuming and costly because they use additional trips into and out of the wellbore.

SUMMARY

Applicant recognized the problems noted herein and conceived and developed embodiments of systems and methods, according to the present disclosure, for wellbore pressure boundary systems.

In an embodiment, a system includes a pressure boundary tool and an installation and retrieval tool. The pressure boundary tool includes a plug body, the plug body having an orifice extending from a first end to second end. The pressure boundary tool also includes a plate coupled to the second end via one or more fasteners, the plate positioned for axial movement along an axis of the pressure boundary tool. The pressure boundary tool further includes a seal arranged within a seal groove formed between the plug body and the plate. The pressure boundary tool also includes a retaining assembly positioned at the second end within the orifice. The pressure boundary tool includes a capture plate arranged over the retaining assembly to maintain a position of the retaining assembly within the orifice. The installation and retrieval tool includes a shaft having first threads on a first shaft end and being non-threaded at a second shaft end, the threads configured to engage mating threads of the plate. The installation and retrieval tool also includes a sleeve having second threads on a first sleeve end and couplers on a second sleeve end, the second threads configured to engage the plug body and the couplers configured to engage the retaining assembly. The first threads and the second threads are configured for use during an installation process and the couplers are configured for use during a retrieval process.

In an embodiment, a system includes a Christmas tree (XT) having at least one valve, the XT being coupled to a wellbore. The system also includes a pressure boundary tool adapted to provide a secondary boundary for the XT. The pressure boundary tool includes a plug body to be positioned against a valve member of the at least one valve; a seal to be energized into a valve body of the at least one valve; and a plate arranged proximate the seal, the plate being moveable between a first position and a second position, the first position energizing the seal and a second position deenergizing the seal. The pressure boundary tool is positioned within the XT on a side of the valve member closer to the wellbore.

In an embodiment, a method includes coupling an installation and retrieval tool to a pressure boundary tool. The method also includes opening a specified valve of a Christmas tree (XT). The method further includes running the pressure boundary tool past a valve member of the specified valve. The method also includes energizing a seal of the pressure boundary tool. The method includes decoupling the installation and retrieval tool from the pressure boundary tool. The method further includes removing the installation and retrieval tool from a flow passage of the specified valve. The method also includes closing the specified valve.

BRIEF DESCRIPTION OF DRAWINGS

The present technology will be better understood on reading the following detailed description of non-limiting embodiments thereof, and on examining the accompanying drawings, in which.

DETAILED DESCRIPTION

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should also be appreciated that dimensions, angles, and other components may be referred to as being substantially within a range of approximately plus or minus 10 percent.

Embodiments of the present disclosure are directed toward systems and methods that may be used to provide secondary pressure boundaries to a wellbore system, such as to a Christmas Tree (XT) (e.g., tree) associated with a wellbore. The secondary pressure boundary may be a removable pressure boundary that may be added or removed from the XT to facilitate one or more maintenance operations, such as replacement or repair of components associated with the XT. In various embodiments, the secondary pressure boundary is installed through an existing valve, such as a gate valve, and then seals against one or more portions of the valve, such as against a valve body. Moreover, after installation, the valve may still be operable due to removal of installation tools, thereby maintaining the pressure boundary provided by the associated valve. One or more embodiments enable servicing and operations of the XT above a lower master valve without trips into the wellbore to shut downhole valves. One or more embodiments enabling serving and operations of one or more wellbore components above a selected valve without additional trips into the wellbore to shut downhole valves.

Figure 1:
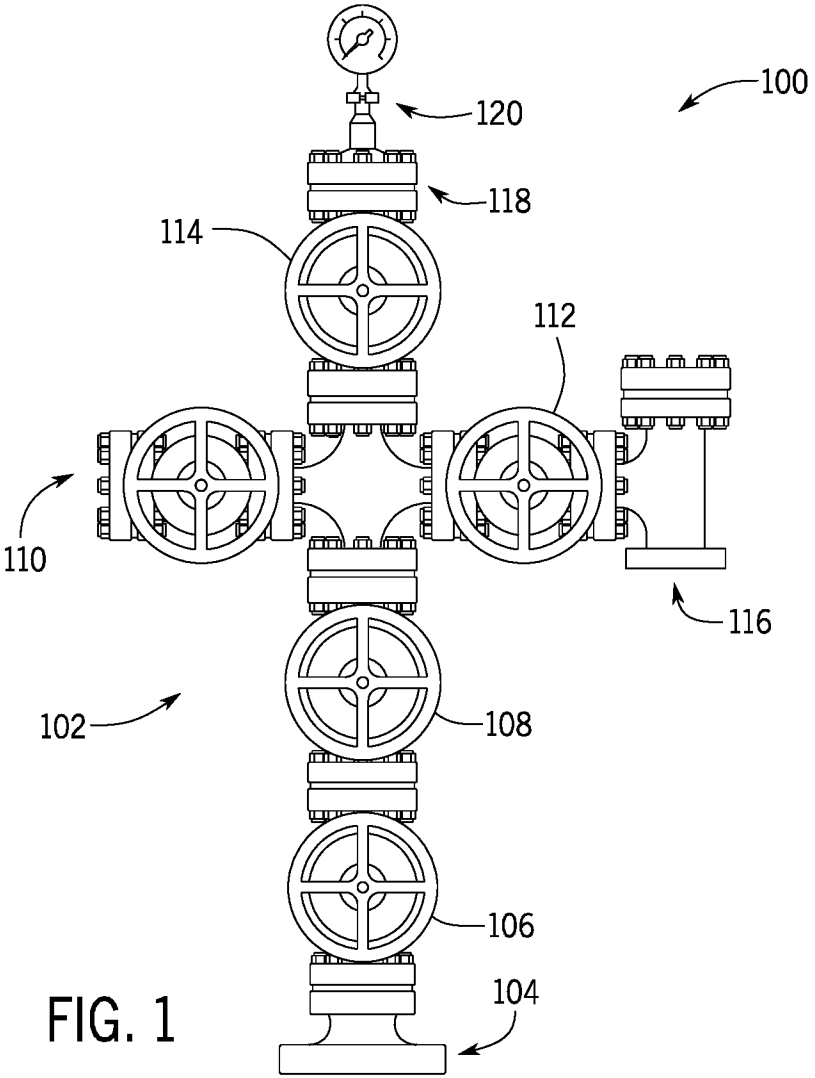
FIG. 1 is a schematic side view of an embodiment of a Christmas tree (XT) as a surface location, in accordance with embodiments of the present disclosure.

FIG. 1 is a schematic side view of an embodiment of a wellhead system 100 that may be utilized with embodiments of the present disclosure. The illustrated wellhead system 100 includes an XT 102 coupled to a tubing head adapter 104, which may be coupled to one or more wellbore components, which are not illustrated here for clarity. It should be appreciated that the wellbore components may include tubulars, valves, flow passages, and the like that may be in fluid communication with the XT 102 and/or that extend into a formation. For example, one or more annuluses may be formed with respect to different tubing sections within the wellbore, where an annulus isolation valve may block or permit flow into the XT 102. It should be appreciated that additional safety systems and valve configurations may also be deployed and utilized with embodiments of the present disclosure.

In this example, the XT 102 includes a number of valves for controlling a flow of fluid, such as a production fluid, into and out of the wellbore. The valves may include master valves, wing valves, swab valves, crown valves, and the like. In this example, the XT includes a lower master valve 106, an upper master valve 108, a wing valve 110 (e.g., a kill wing valve), a wing valve 112 (e.g., a production wing valve), and a swab valve 114 (e.g., a crown valve). Additionally tree components also include a surface choke 116, a tree adapter 118, and a gauge 120. It should be appreciated that the configuration of FIG. 1 is for illustrative purposes only and that various embodiments may include more or fewer valves. Additionally, different types of valves may also be used in different configurations and the arrangement of the valves shown herein, as well as the types of valves, is for illustrative purposes only and is not intended to limit the scope of the present disclosure.

During wellbore operations, it may be desirable or necessary to service one or more components of the XT 102. For example, valves may be replaced or serviced, different flow lines may be added, and the like. As a result, the wellbore is closed in or otherwise isolated prior to operations on the XT. Shutting in the wellbore typically includes one or more trips into the wellbore, where a tool may be lowered in through the XT 102 and then engaged, such as a packer that blocks flow or activates one or more other systems. These operations are typically costly and time consuming, as each trip into the wellbore may take several hours. However, such trips are often necessary to comply with industry standards regarding wellbore isolation, as having more pressure boundaries is desirable prior to working on the XT 102. Systems and methods of the present disclosure may include one or more boundary tools that enable installation of a secondary boundary associated with the XT 102, such as at the lower master valve 106, among other locations. However, it should be appreciated that embodiments of the boundary tools may be installed at any appropriate location.

Systems and methods may include a pressure boundary tool that is installed through one or more portions of the XT 102, such as through the tree adapter 118, to a desired location, such as a location associated with one or more of the valves. For example, the selected vale may be the lower master valve 106, which may be in an open or partially open position as the pressure boundary tool is run through the XT 102. Once positioned at the desired location, the lower master valve 106 (or any other associated valve) may be partially closed to facilitate positioning of the pressure boundary tool, such as arranging the pressure boundary tool such that one or more portions of the valve contact one or more portions of the pressure boundary tool (e.g., an outer sleeve as will be described herein). Such a positioning may be useful to enable the master valve 106 to maintain operational capabilities after installation of the pressure boundary tool. A plug body may then be driven in an uphole direction to contact a valve member of the lower master valve 106 and a plate may be driven against the plug body to compress a seal against a valve body. Once positioned, the running tool associated with the pressure boundary tool may be decoupled from the plug body and retrieved, thereby permitting operations above the lower master valve 106. By activating both the pressure boundary tool and the lower master valve 106, a double pressure boundary may be set below the remaining tree components.

In at least one embodiment, systems and methods may permit retrieval and removal of the pressure boundary tool. For example, the tool described above may have an installation end and a retrieval end positioned at opposite ends of the tool. During installation, the installation end may be coupled to the plug body. However, during retrieval, the tool may be flipped so that the retrieval end engages the plug body. The different ends may use different coupling mechanisms. For example, the installation end may use one or more threaded fittings because there may be a reduced risk of misalignment when aligning threaded fittings at a surface location prior to installation. However, they retrieval end may use different coupling mechanisms, such as various grooves or press fitting configuration. The engagement with the plug body may be via a collect interface, among other options. Thereafter, a piston may be threaded to deactivate the seal to permit movement away from the valve member. Additionally, in various embodiments, one or more manual operations may be used to deactivate the seal. Accordingly, the valve member may be opened and the pressure boundary tool may be removed, permitting further operations.

Figure 2:
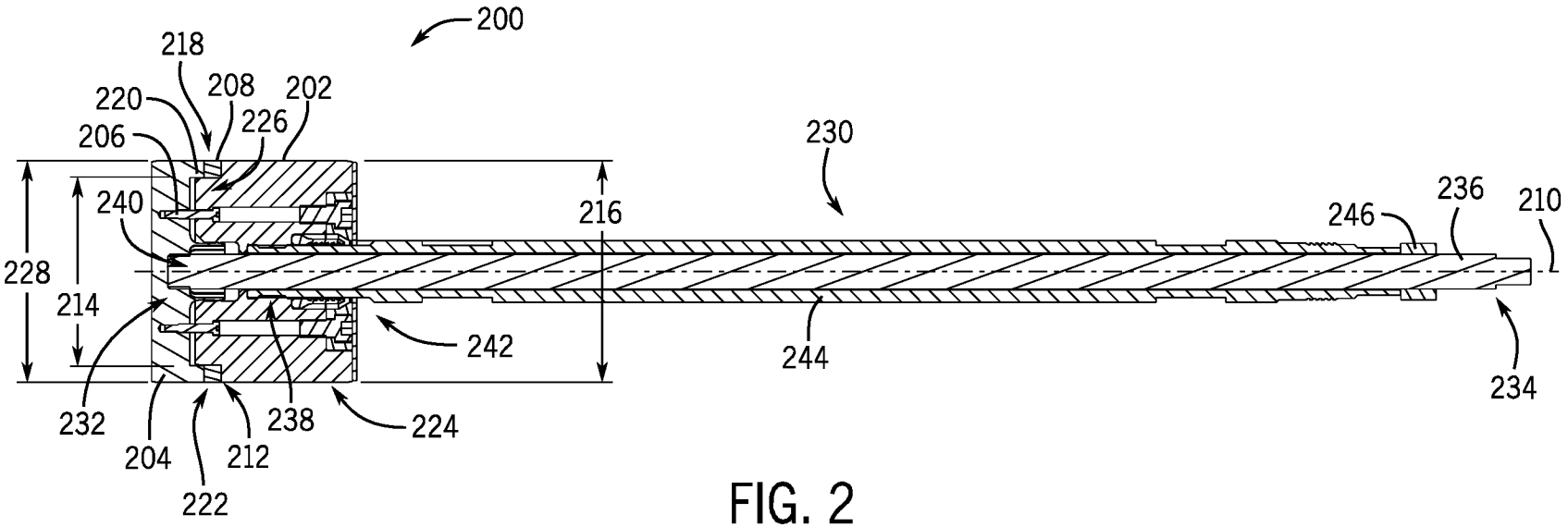
FIG. 2 is a cross-sectional view of an embodiment of a pressure boundary system, in accordance with embodiments of the present disclosure.

FIG. 2 is a schematic cross-sectional view of an embodiment of a pressure boundary tool 200 (e.g., tool, boundary tool, secondary boundary tool, etc.) that may be used with embodiments of the present disclosure. The pressure boundary tool 200 may be part of wellbore system that may include both the tool 200 and one or more installation and retrieval tools, as will be described herein. It should be appreciated that one or more features of the pressure boundary tool 200 have been simplified for clarity with the present discussion and that, in various embodiments, additional or alternative components may be used. In this example, the pressure boundary tool 200 includes a plug body 202 (e.g., body) that is coupled to a plate 204 (e.g., energizing plate) via one or more fasteners 206. The illustrated plug body 202 may be substantially annular, for example the body 202 may be cylindrical such that it fits within the openings associated with the XT 102 and associated components. However, the configuration showing generally planar ends of both the plug body 202 and the plate 204 is for illustrative and non-limiting purposes, as the ends may be curved, stepped, angled, or any other reasonable configuration in accordance with expected operating conditions.

A seal 208 (e.g., annular seal, seal assembly) is positioned axially, along a tool axis 210, between the plug body 202 and the plate 204. The seal 208 may be formed from any suitable material, such as an elastomer. It should be appreciated that the inclusion of a single annular seal 208 is for illustrative purposes only and that, in other configurations, that may be a stack or seals 208 and/or additional seals with associated components, such as additional plates. For example, the plate 204 may compress against a first seal, which compresses against a second plate, which compresses against a second seal, which compresses against the plug body 202. In this manner, additional sealing capabilities may be provided and/or redundancy may be incorporated to reduce a likelihood of a failure to energize or set the seals. In operation, energizing or setting the seal 208 may refer to apply a pressure to the seal 208 such that the seal expands axially to contact a surrounding body to form a pressure barrier to block fluid flow. The seal 208 is arranged within a seal groove 212, which is a reduced diameter portion of the plug body 202 such that a seal groove diameter 214 is less than a body outer diameter 216. In this configuration, a plate contact area 218 is sized to fit within the seal groove 212 and to compress the seal 208 via one or more extensions 220. In this example, the extensions 220 are sized such that a first plug end 222, opposite a second plug end 224, fits within a recess 226 formed between the extensions 220. In various embodiments, a plate outer diameter 228 is substantially equal to the body outer diameter 216, but it should be appreciated that the plate outer diameter 228 may be greater than or less than the plug outer diameter 216 in other embodiments.

The illustrated tool 200 is coupled to an installation and retrieval tool 230 that may be utilized to both install the tool 200 within the XT 102 and/or one or more components associated with the XT 102. In this example, the installation and retrieval tool 230 includes an installation end 232 and a retrieval end 234, which different ends 232, 234 are used during installation and retrieval operations. In this example, the installation end 232 is coupled to the tool 200. A shaft 236 of the installation and retrieval tool 230 is shown coupled to the plate 204, for example via threads. It should be appreciated that a threaded connection is shown as an example and different couplings may be used in other configurations. The shaft 236 extends through a variable diameter orifice 238, which includes a first region 240 and a second region 242. A distance along the axis 210 between the first region 240 and the plate 204 is less than a distance along the axis 210 between the second region 242 and the plate 204. In other words, the illustrated first region 240 is closer to the plate 204 than the second region 242. As will be discussed herein, one or more components may be positioned within the first and second regions 240, 242 to facilitate coupling between the shaft 236 and/or a sleeve 244 and the body 202.

The tool 230 further includes the sleeve 244, through which the shaft extends 236. A nut 246 is also coupled to the shaft 236 proximate the retrieval end 234 that may, when rotated, drive axial movement of the shaft 236 along the axis 210. For example, rotation of the nut 246 may drive the shaft 236 in a direction away from the plate 204, thereby driving the plate 204 toward the nut 246 and compressing the seal 208. As will be described below, in various embodiments the tool 230 may be removed and then flipped 180 degrees so that the retrieval end 234 may engage the plate 204 and/or the plug body 202 to deenergize the seal 208 and permit removal of the tool 200.

Figure 3A:
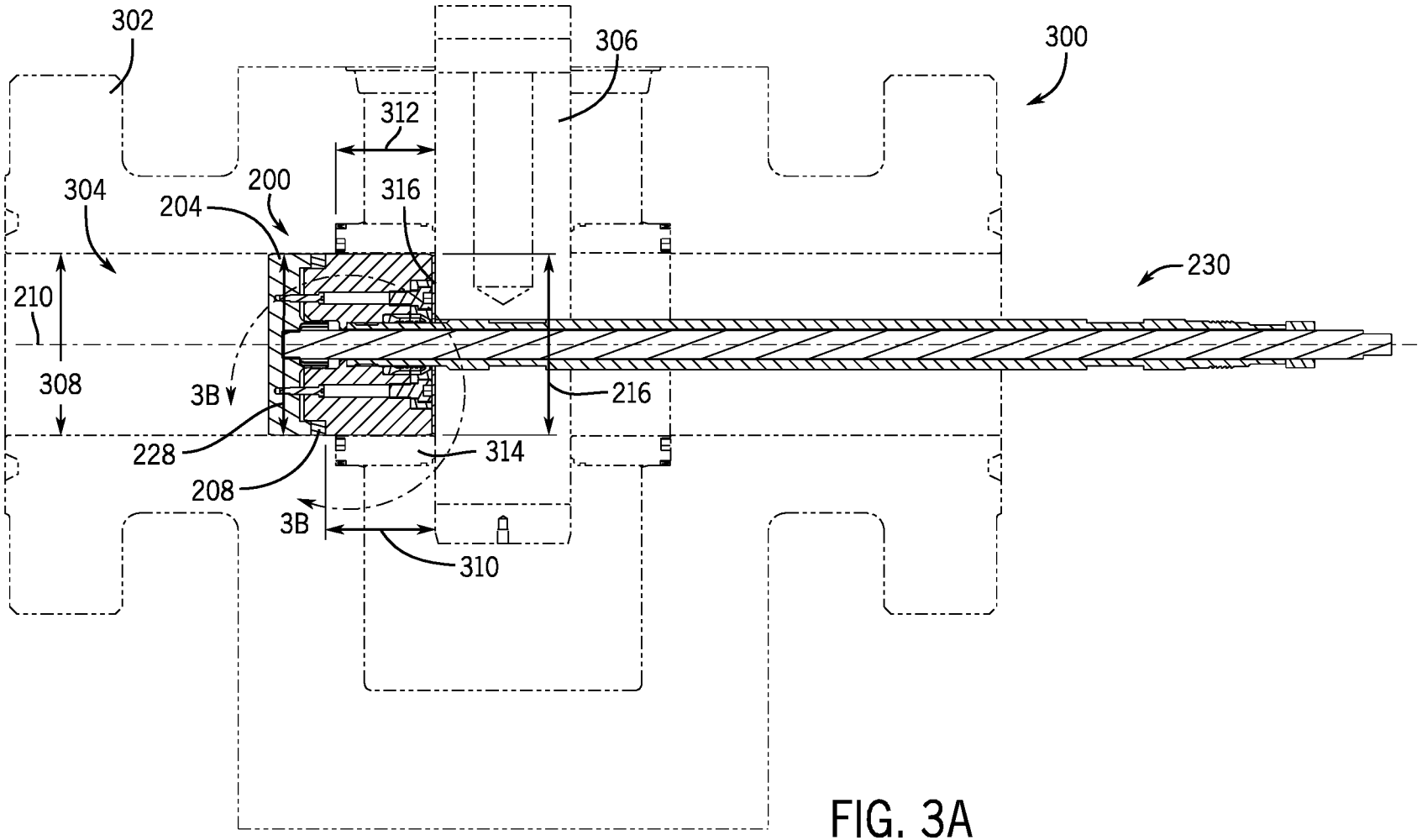
FIG. 3A is a cross-sectional view of an embodiment of pressure boundary system, where a pressure boundary tool is in an installation position, in accordance with embodiments of the present disclosure.

FIG. 3A is a cross-sectional view of an embodiment of an install position 300 in which the pressure boundary tool 200 is being installed, via the installation and retrieval tool 230, within a valve body 302. As shown, the pressure bound tool 200 is arranged within a flow passage 304 of the valve body 302 in a position that is axially beyond a valve member 306. In this configuration, axially beyond refers to a downhole position or a position that is closer to the wellbore than an axially above position. In other words, fluid flowing out of the wellbore along the flow passage 304 would contact the pressure boundary tool 200 prior to contacting the valve member 306 in the illustrated configuration. In this example, the valve member 306 is in an open position that permits passages of the pressure boundary tool 200 through the flow passage 306. Moreover, as shown, the outer diameters 216, 228 are substantially equal to a flow passage diameter 308.

The pressure boundary tool 200 is shown in an un-set position (e.g., a deenergized position) where the seal 208 has not been compressed by the plate 204. Accordingly, the pressure boundary tool 200 may be moved along the axis 210 to a desired location, for example, to a position where the seal 208 is aligned with the valve body 302. That is, a plug body length 310 may be longer than a valve seat length 312 of a valve seat 314 so that the seal 208 seals against the valve body and not the valve seat 314. It should be appreciated that, in various embodiments, the seal 208 may seal against the valve seat 314.

One or more embodiments may include an indicator along at least one of the shaft 236 and/or the sleeve 244 to assist with placing the pressure boundary tool 200. For example, a marker may be arranged on the shaft 236 that is aligned with the nut 246 when the pressure boundary tool 200 is positioned at a pre-determined location. Such an indicator may reduce a likelihood of damage to the valve set 206 when it is closed, at least partially, and/or may reduce a likelihood of misplacement and realignment of the pressure boundary tool. 200. Various types of indicators may be used with embodiments of the present disclosure, such as different colors along the shaft 236, a fitting that is placed on the shaft 236 that contacts the nut 246 at the desired location, and the like. In at least one embodiment, a position of the pressure boundary tool 200 may, at least partially, be verified by partially closing the valve member 206 such that the valve member 206 contacts the sleeve 244. For example, because the body diameter 216 is larger than an associated sleeve diameter, the valve member 206 will not move as far if the plug body 202 is in the way, as compared to the sleeve 244. This may provide as a secondary check (or the primary check) and may be used as additional verification, along with or in place of, the indicator.

In various embodiments, the plug body 202 may be pulled or otherwise driven back and toward the valve member 306 such that the second plug end 224 contacts the valve member 306. In various embodiments, one or more disks 316 may be arranged at the second plug end 224 to prevent damage to the valve member 306. For example, the disk 316 may be formed from a soft material (e.g., softer than the valve member 306) to prevent damage. The disk 316 may be fastened to the second plug end 224 by a variety of methods, such as a counter-sunk screw, as one example.

Figure 3B:
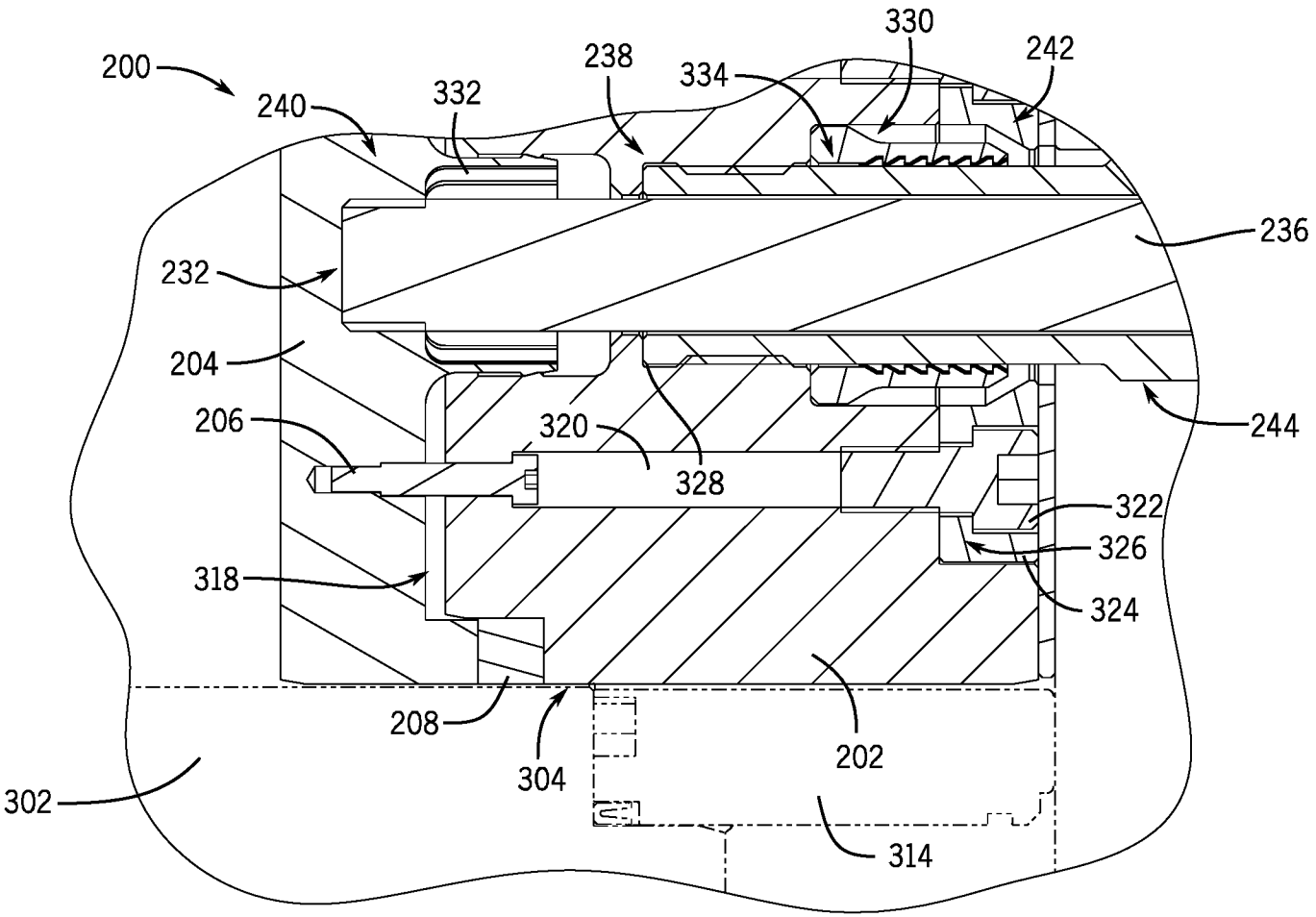
FIG. 3B is a detailed view taken along 3B-3B of an embodiment of a pressure boundary tool, in accordance with embodiments of the present disclosure.

FIG. 3B is a detailed view taken along 3B-3B showing the pressure boundary tool 200 arranged within the flow passage 304. As shown, a gap 318 is formed between the plug body 202 and the plate 204, indicating that the seal 208 is in the un-set position (e.g., that the plate 204 has not been driven back and toward the plug body 202). The illustrated seal 208 is positioned against the valve body 302, and not the vale seat 314, as noted above. However, it should be appreciated that various other embodiments may provide for different positions of the seal 208. Furthermore, as noted above, various embodiments may include multiple seals 208 where a portion of the seals 208 seal against the valve body 302 and a portion of the seals 208 seal against the valve seat. Moreover, embodiments with multiple seals 208, all seals 208 may seal against the valve body 302 and/or all seals 208 may seal against the valve seal 314.

Further illustrated are the fasteners 206 extending between the plug body 202 and the plate 204. The fasteners 206 are arranged within a passage 320 formed within the plug body 202 that also includes an opposite fastener 322 for securing a capture plate 324 to the plug body 202 at the second end 224. It should be appreciated that inclusion of both the fastener 206 and an associated opposite fastener 322 within a common passage 320 is shown for illustrative purposes and the fasteners 206, 322 may not share a common passage 320. However, using a common passage may simplify installation and assembly, as well as manufacturing. The illustrated capture plate 324 is positioned within a recess 326. As will be described, the capture plate 324 may be used to secure a collet configuration within the orifice 238 to facilitate removal without threading the retrieval end 234 to the plug body 202. The disk 316 is shown as covering the capture plate 324, which as noted above, may decrease a likelihood of damage to the valve member 306 during operations. Now illustrated are fasteners that may be used to secure the disk 316 to the plate 324 and/or the plug body 202. It should be appreciated that various other coupling mechanisms may also be used.

In this example, the orifice 328 includes the first region 240 and the second region 242, where the first region 240 is proximate the plate 204 and the second region is proximate the capture plate 324. The first region 240 may facilitate coupling of the shaft 236 to the plate 204, for example through a threaded connection. The second region 242 receives the shaft 236 and the sleeve 244, where the sleeve 244 may abut against a stop shoulder 328. It should be appreciated that the sleeve 244 may also be threaded to the plug body 202. Further positioned within the second region 242 is a collet assembly 330, which may be utilized during removal operations. For example, in this configuration, the shaft 236 and the sleeve 244 may pass through the collet assembly 330, but during removal, the collet assembly 330 may engage the retrieval end 234 of the tool 230.

In the illustrated configuration, the installation end 232 is shown engaging the plate 204. For example, one or more threads may be utilized to couple to mating threads of the 204, but other coupling mechanisms may also be used, such as bayonet connections, tongue and grooves, dogs, and the like. In this example, an anti-rotation mechanism 332 is positioned within the first region 240. The anti-rotation mechanism may block rotation of the body 202 with respect to the shaft 236 during removal of the installation end 232. For example, one or more pins may extend outwardly such that rotation of the shaft 236, for example due to the nut 246, is not transmitted to the plug body 202. It should be appreciated that various other anti-rotation pins or mechanisms may be utilized to block rotation of various components.

As noted above, the installation and retrieval tool 230 may include two opposite ends, where the installation end 232 shown in FIG. 3B includes a substantially smooth outer sleeve region 334. This outer sleeve region 334 is substantially aligned with the collet assembly 330, but due to the lack of grooves or other mating components, does not engage the collect assembly 330. Accordingly, the sleeve 244 can freely rotate and/or pass through the collet assembly 330 without engaging the collet assembly 330. As will be described below, a different configuration may be used on the retrieval end 234 to facilitate coupling to the collet assembly 330 for removal of the pressure boundary tool 200.

Figure 4A:
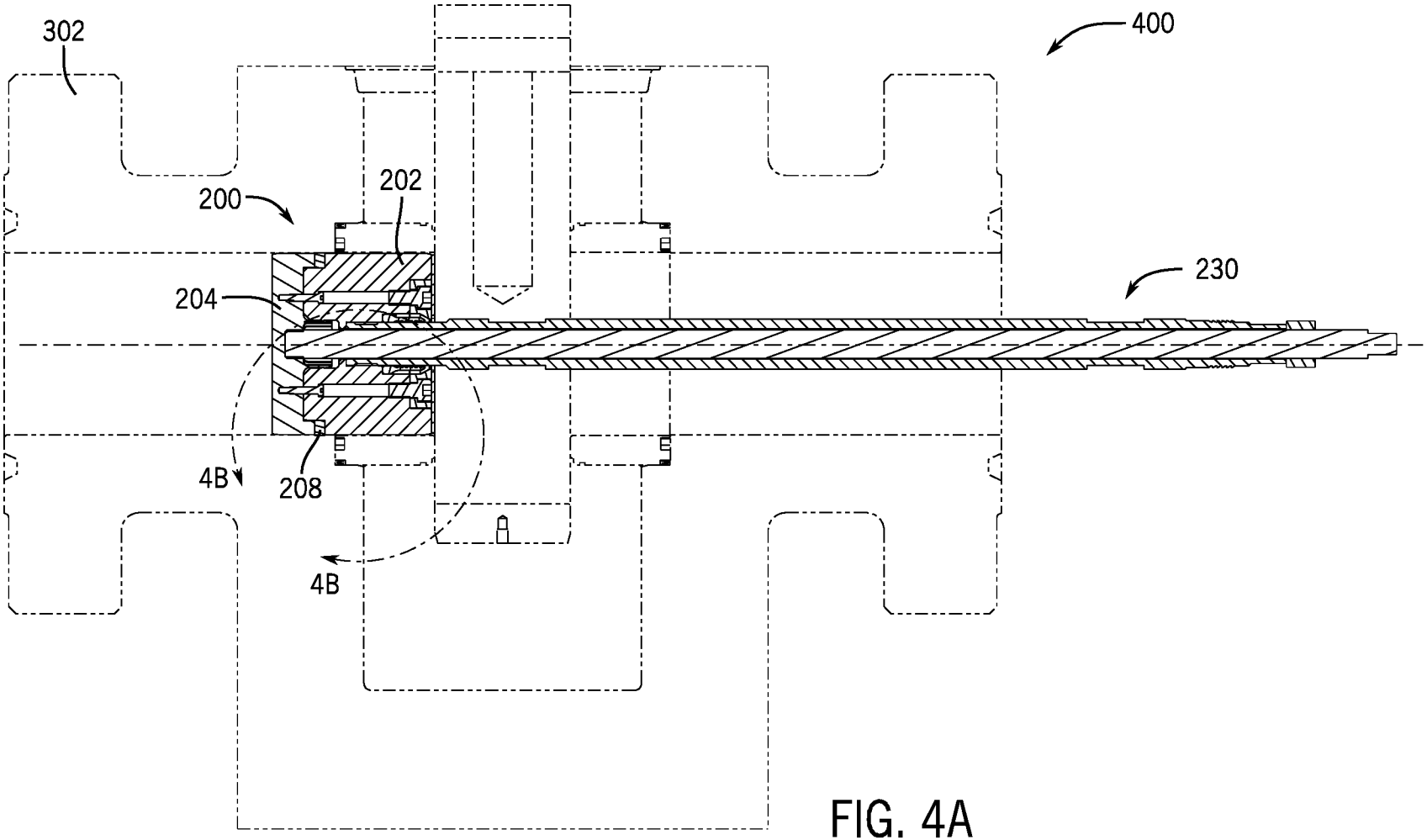
FIG. 4A is a cross-sectional view of an embodiment of pressure boundary system, where a pressure boundary tool is in a set position, in accordance with embodiments of the present disclosure.

FIG. 4A is a cross-sectional view of an embodiment of a set position 400 in which the pressure boundary tool 200 is installed, via the installation and retrieval tool 230, within a valve body 302. In this example, the seal 208 is set against the valve body 302, for example via driving movement of the plate 204 toward the plug body 202. However, as illustrated, the install and retrieval tool 230 remains coupled to the plug body 202. As a result, further operations on the XT 102 may not commence.

Figure 4B:
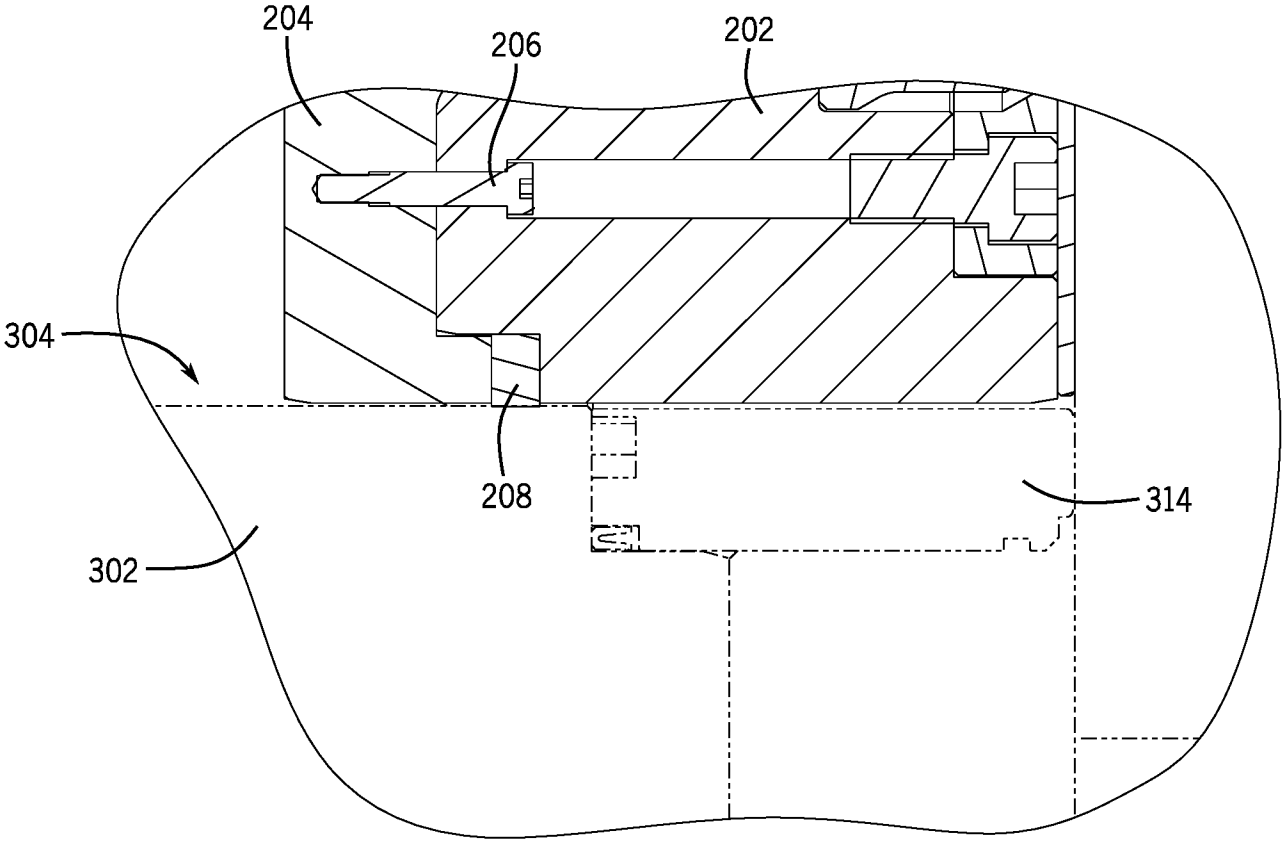
FIG. 4B is a detailed view taken along 4B-4B of an embodiment of a pressure boundary tool, in accordance with embodiments of the present disclosure.

FIG. 4B is a detailed view taken along 4B-4B showing the pressure boundary tool 200 arranged within the flow passage 304 in a configuration where the seal 208 is in a set position (e.g., an energized position) so that the seal 208 is driven against the valve body 302. As shown, the plate 204 has been driven against the plug body 202 such that the gap 318 is no longer present. It should be appreciated that the gap 318 may only be decreased and that the plate 204 may not contact the plug body 202 in all configurations. Accordingly, a seal may now be formed along the flow passage 304.

In operation, the movement of the plate 204 may be driven, at least in part, by the nut 246. For example, the nut 246 may be rotated to drive the shaft 236 in a direction such that the plate 204 moves toward the plug body 202. As noted above, the plug body 202 may be driven against the valve member 306, and as a result, the plug body 202 may remain stationary as the plate 204 moves, thereby compressing the seal 208 to engage the valve body 302. For example, the rotation of the nut 246 may cause the shaft 236 to travel along the sleeve 244, and due to the connection of the sleeve 244 and plug body 202, the shaft 236 travels such that the plate 204 is driven toward the plug body 202.

Figure 5A:
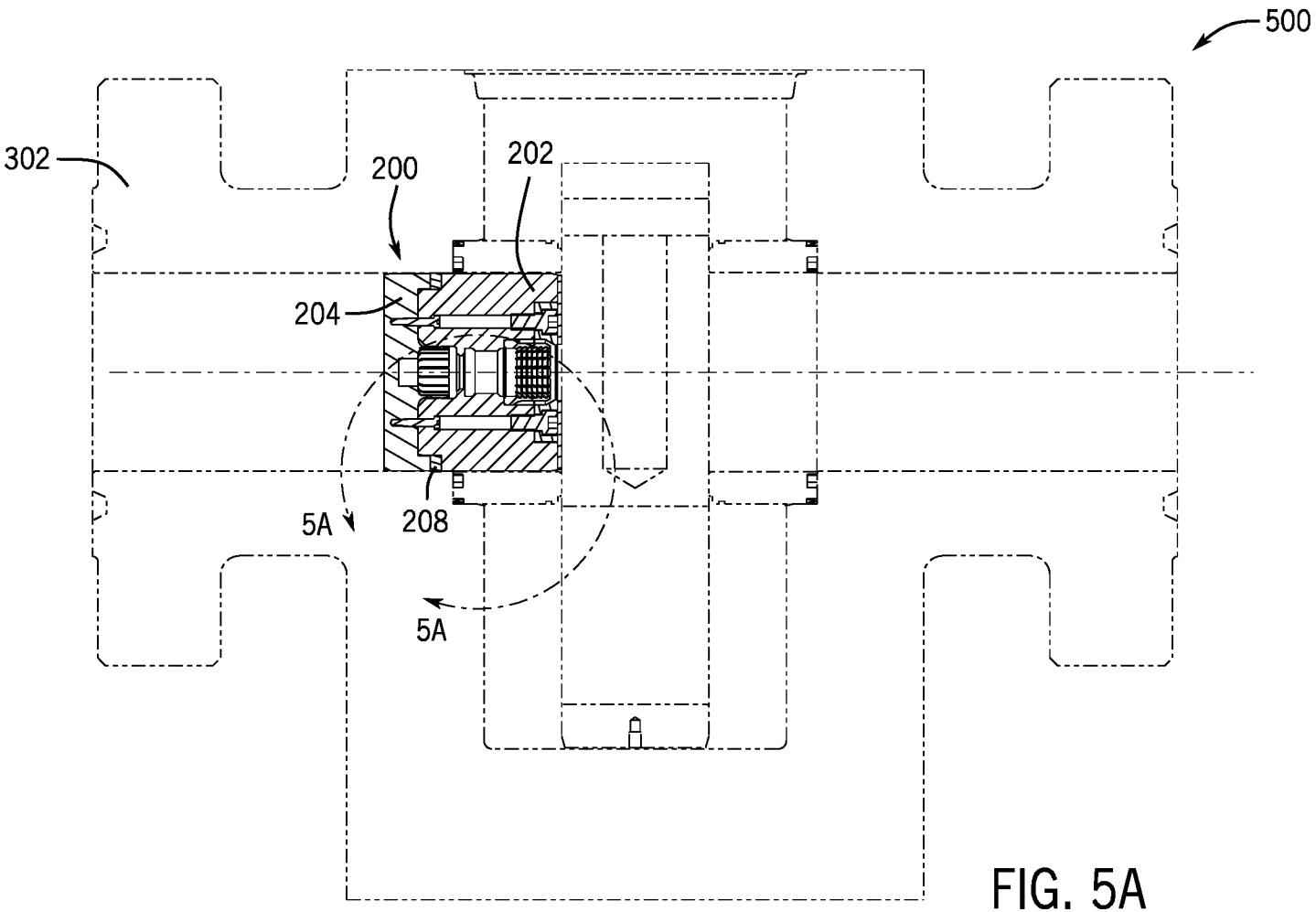
FIG. 5A is a cross-sectional view of an embodiment of pressure boundary system, where a pressure boundary tool is in a set and removed position, in accordance with embodiments of the present disclosure.

FIG. 5A is a cross-sectional view of an embodiment of a set and removed position 500 in which the pressure boundary tool 200 is installed within the valve body 302 and the installation and retrieval tool 230 is removed. In this configuration, the installation end 232 has been unthreaded from the plate 204, and the sleeve 244 is unthreaded from the plug body 202, to permit removal of the tool 230. Accordingly, one or more operations may commence on the XT 102. In one or more embodiments, the valve member 306 may be closed to provide an additional boundary layer after removal of the tool 230.

Figure 5B:
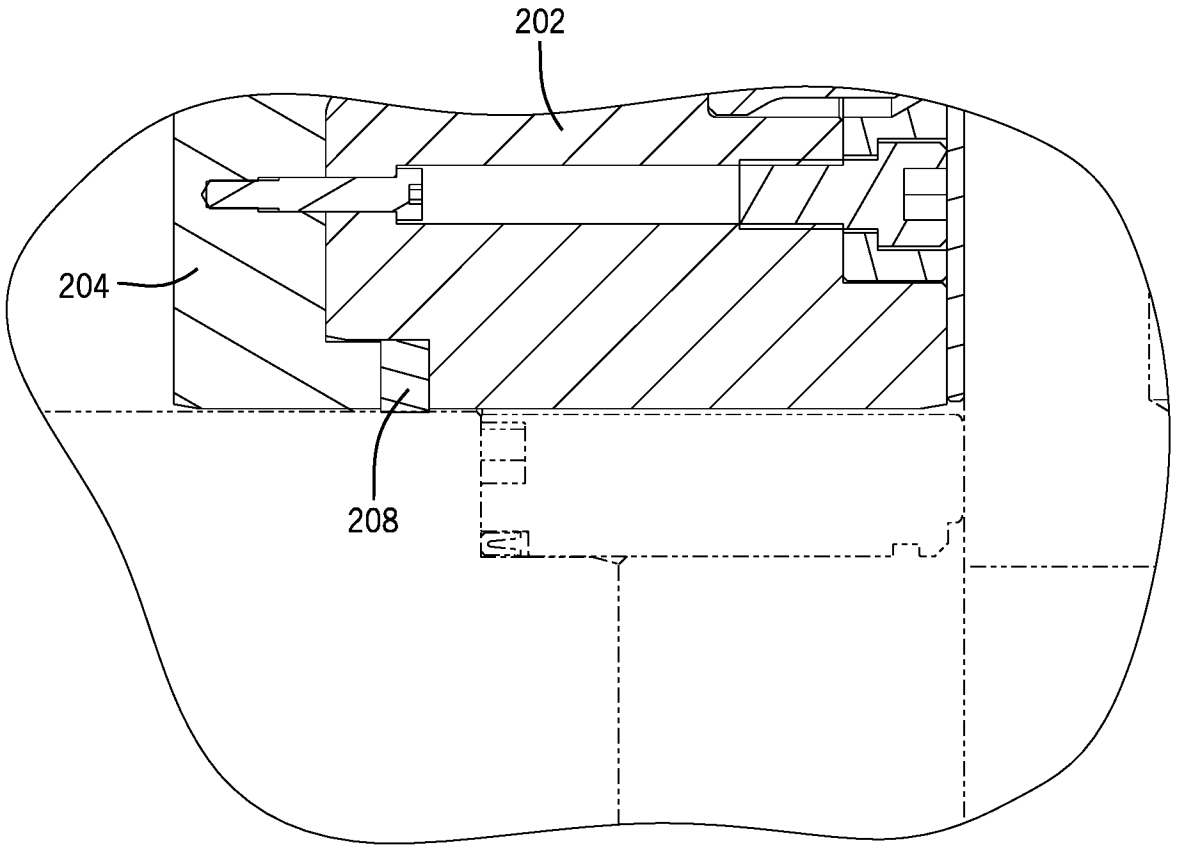
FIG. 5B is a detailed view taken along 5B-5B of an embodiment of a pressure boundary tool, in accordance with embodiments of the present disclosure.

FIG. 5B is a detailed view taken along 5B-5B showing the pressure boundary tool 200 arranged within the flow passage 304 in a configuration where the seal 208 is in a set position (e.g., an energized position) so that the seal 208 is driven against the valve body 302. As shown, the plate 204 has been driven against the plug body 202 such that the gap 318 is no longer present. Additionally, while not pictured in FIG. 5B, the tool 230 has been removed without affecting the surrounding components.

Figure 6A:
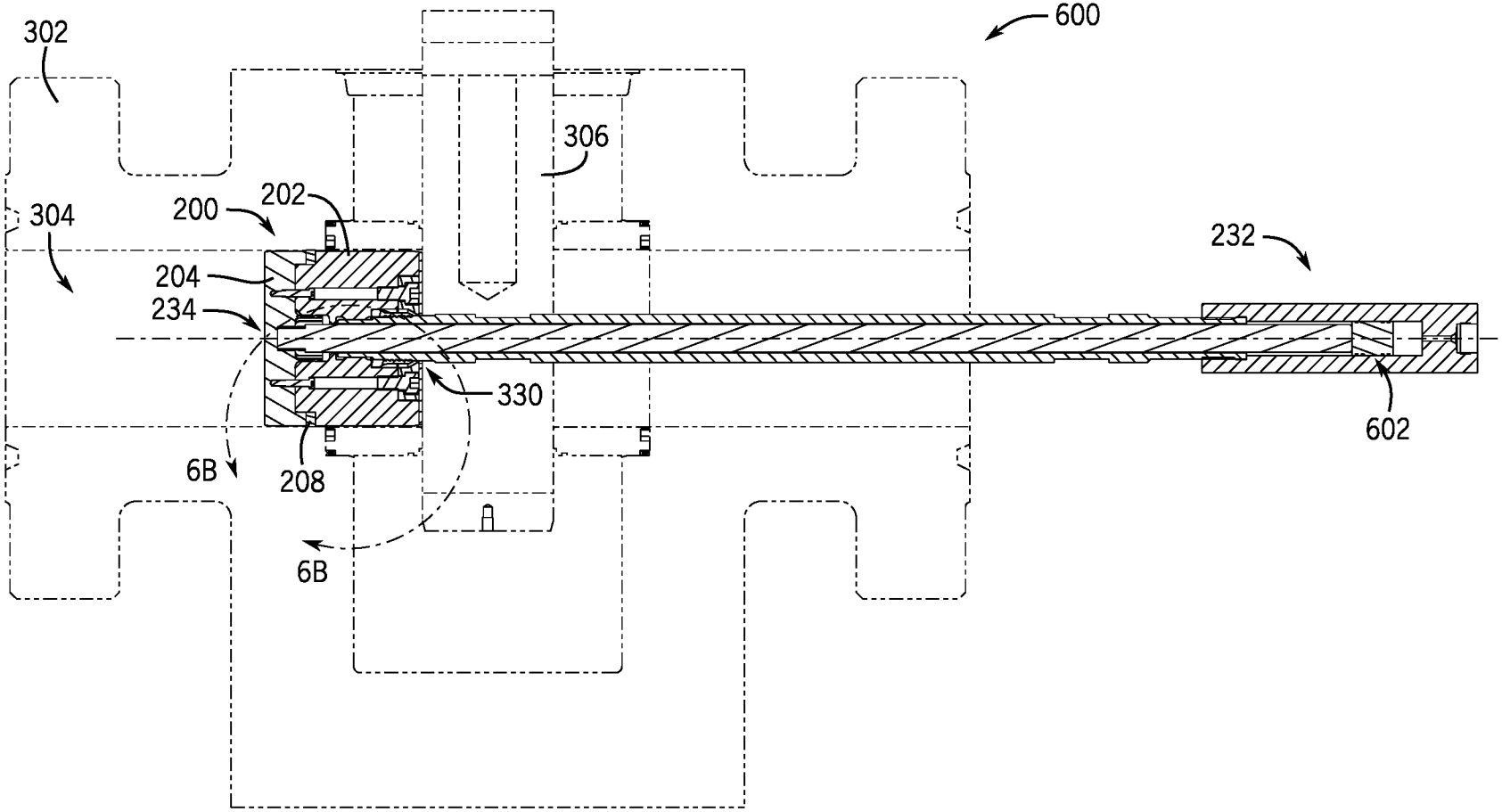
FIG. 6A is a cross-sectional view of an embodiment of pressure boundary system, where a pressure boundary tool is in set retrieval position, in accordance with embodiments of the present disclosure.

FIG. 6A is a cross-sectional view of an embodiment of a set retrieval position 600 in which the pressure boundary tool 200 is installed within the valve body 302 and the installation and retrieval tool 230 is installed such that the retrieval end 234 engages the plug body 202, rather than the installation end 232. In this configuration, the retrieval end 234 is installed within the orifice 238 and interacts with the collet assembly 330. As will be described, an end of the retrieval end 234 may not include threads, and as a result, no threaded connection is formed between the retrieval end 234 and the plate 204.

Prior to removal, the seal 208 is deenergized. In other words, the plate 204 is driven away from the plug body 202 so that the seal 208 is no longer compressed against the valve body 302. In this example, a piston 602 is attached to the tool 230 to provide an axial force along the axis 210 in drive the plate 204 away from the plug body 202. Accordingly, removal steps may include opening the valve to remove the valve member 302 from the flow passage 304, engaging the collet assembly 330 via one or more grooves, while other portions are not threaded to the tool 230, coupling the piston 602 to the tool 230, and then applying a force to the plate 204 to deenergize the seal 208. It should be appreciated that the piston 602 is shown as an example and that other embodiments may utilize different mechanisms to deenergize the plate 204, including but not limited to manual methods.

As noted above, the retrieval end 234 is used, rather than the installation end 232. Advantageously, these may be different ends of the same tool 230, thereby eliminating a need to have different components at the site for installation and removal. Moreover, by eliminating threads from the retrieval end 234, there may be a reduced likelihood of damage or error during the retrieval process. For example, it may be challenging to properly engage threads.

Figure 6B:
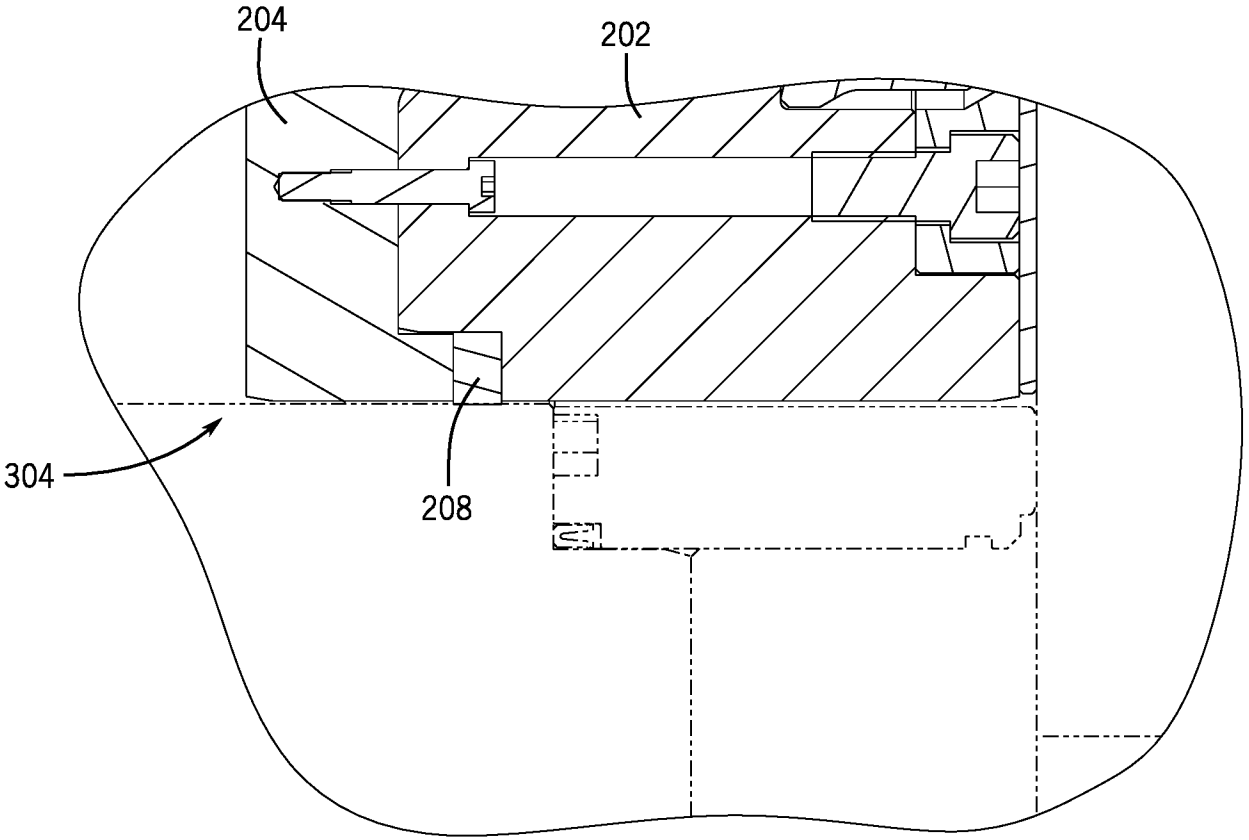
FIG. 6B is a detailed view taken along 6B-6B of an embodiment of a pressure boundary tool, in accordance with embodiments of the present disclosure.

FIG. 6B is a detailed view taken along 6B-6B showing the pressure boundary tool 200 arranged within the flow passage 304 in a configuration where the seal 208 is in a set position (e.g., an energized position) so that the seal 208 is driven against the valve body 302. This view is shown prior to activation of the piston 602 to deenergize the seal 208.

Figure 6C:
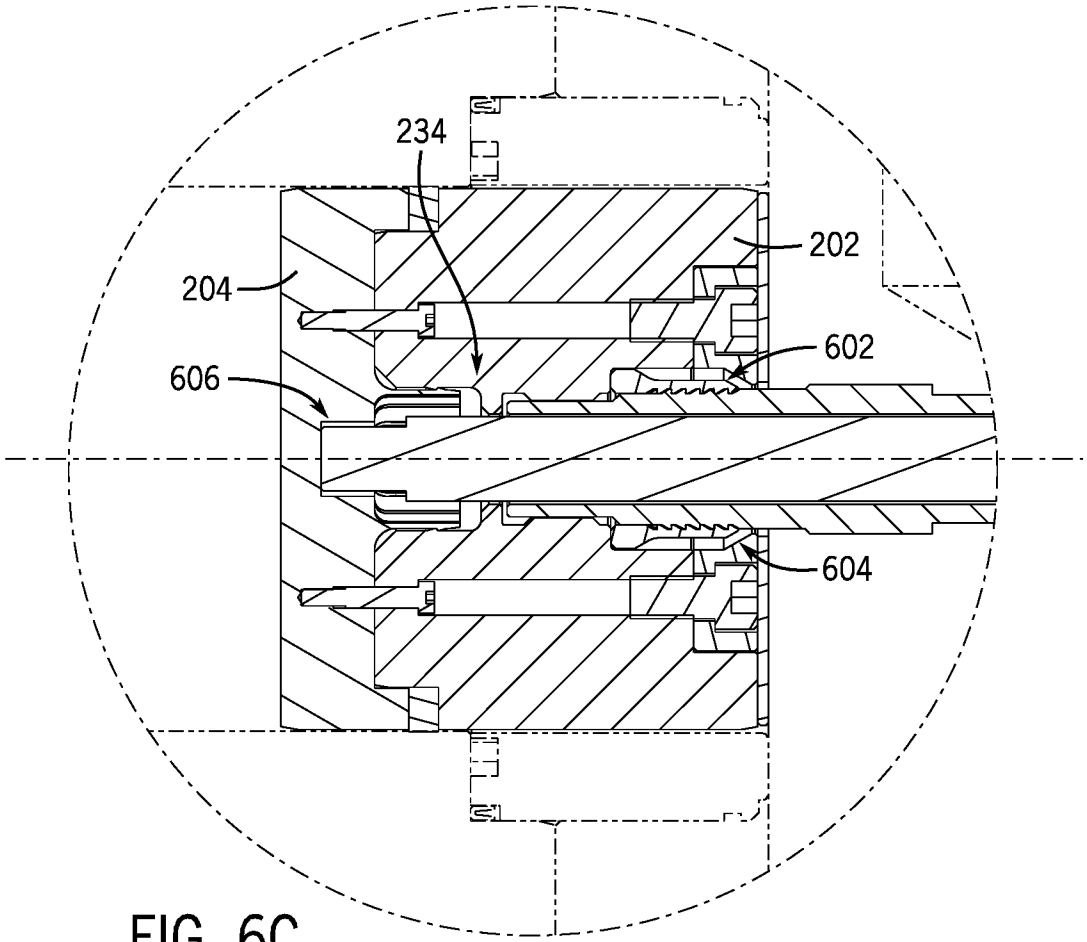
FIG. 6C is a cross-sectional view of an embodiment of a pressure boundary tool coupled to a retrieval end, in accordance with embodiments of the present disclosure.

FIG. 6C is a detailed view showing the pressure boundary tool 200 in which the retrieval end 234 has engaged the collet assembly 330 via one or more grooves 602 formed along an outer sleeve region 604. For example, a shape of the collet assembly 330 may conform to the grooves 602 such that passage in a first direction (e.g., toward the plate 204) is permitted, but as will be described below, movement in a second direction (e.g., toward the disk 316) is blocked due to the engagement of the grooves 602 and/or the capture plate 324. Accordingly, removal is facilitated without rotating or otherwise threading the components, such as the shaft 236 and/or the sleeve 244. In this example, it can be seen that the anti-rotation mechanism 332 is not engaged with a far end 606, and moreover, the far end 606 does not engage the threads of the plate 204. This configuration may enable simplified retrieval operations.

Figure 7A:
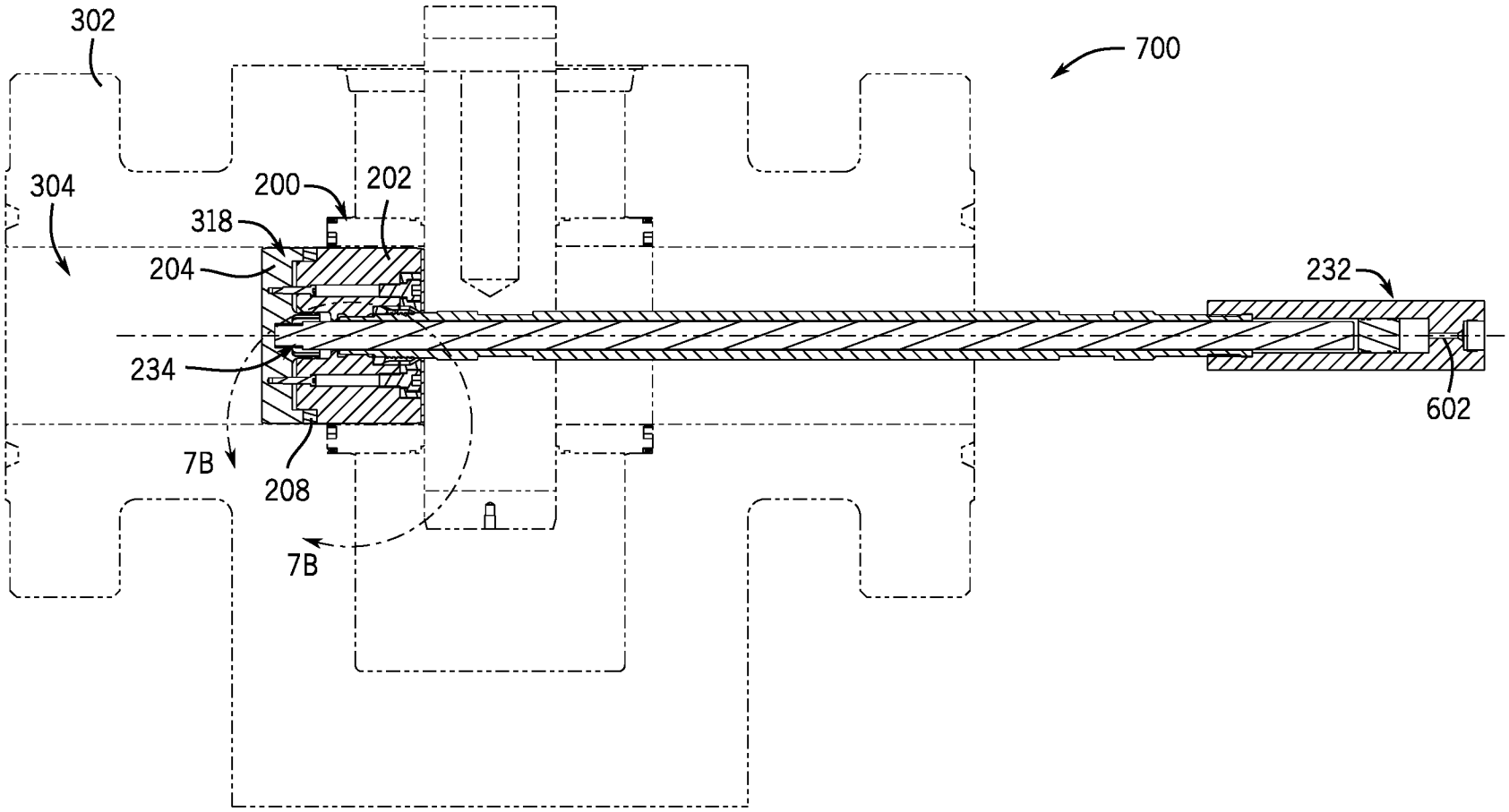
FIG. 7A is a cross-sectional view of an embodiment of pressure boundary system, where a pressure boundary tool is in a unset retrieval position, in accordance with embodiments of the present disclosure.

FIG. 7A is a cross-sectional view of an embodiment of an unset retrieval position 700 in which the pressure boundary tool 200 is installed within the valve body 302 and the installation and retrieval tool 230 is installed such that the retrieval end 234 engages the plug body 202, rather than the installation end 232. In this configuration, the piston 602 has unset (e.g., deenergized) the seal 208 by driving the plate 204 away from the plug body 202 along the axis 210. As a result, the gap 318 has returned and the pressure boundary tool 200 may be removed from the flow passage 304.

Figure 7B:
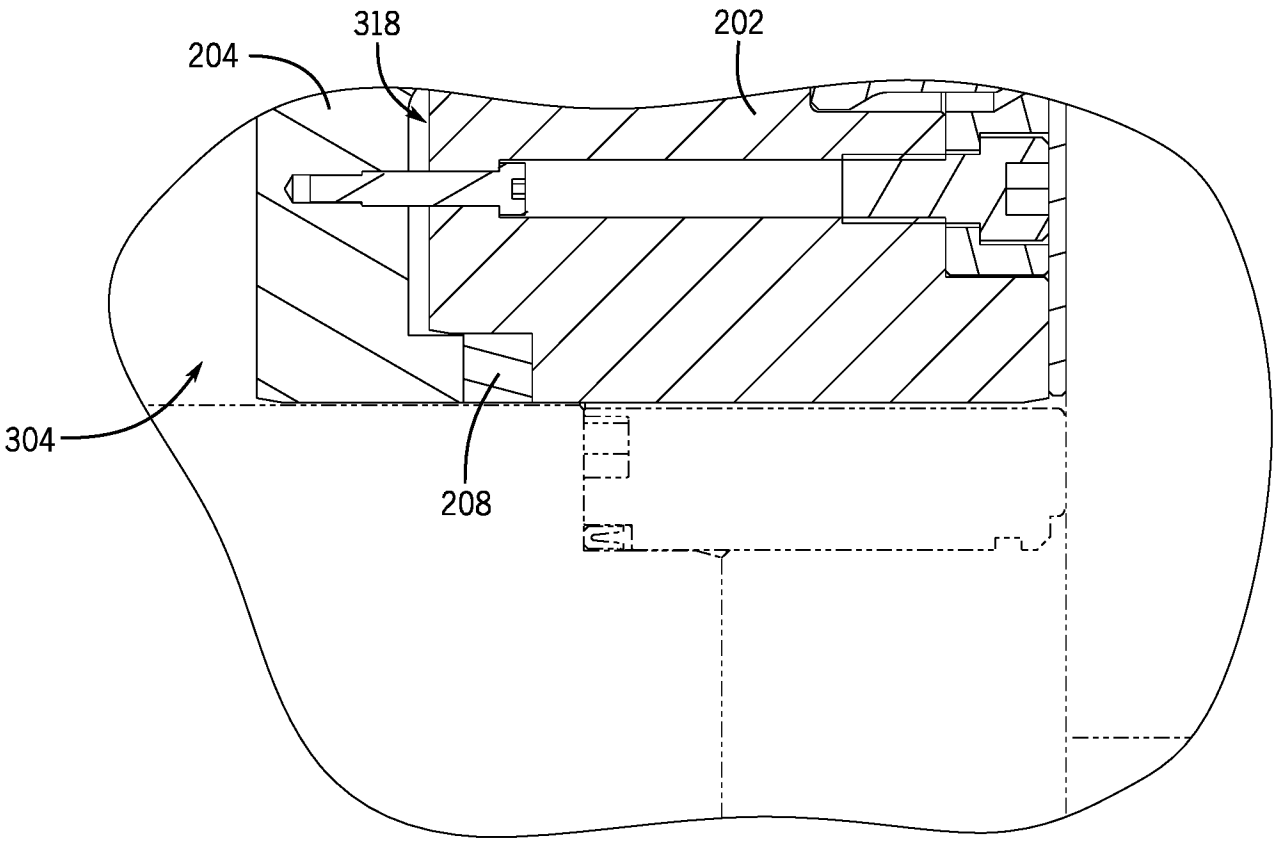
FIG. 7B is a detailed view taken along 7B-7B of an embodiment of a pressure boundary tool, in accordance with embodiments of the present disclosure.

FIG. 7B is a detailed view taken along 7B-7B showing the pressure boundary tool 200 arranged within the flow passage 304 in a configuration where the seal 208 is in an unset position (e.g., a deenergized position) where the gap 318 between the plate 204 and the plug body 202 is visible. This view is shown after activation of the piston 602 to deenergize the seal 208, which may now be removed from the flow passage 304.

Figure 7C:
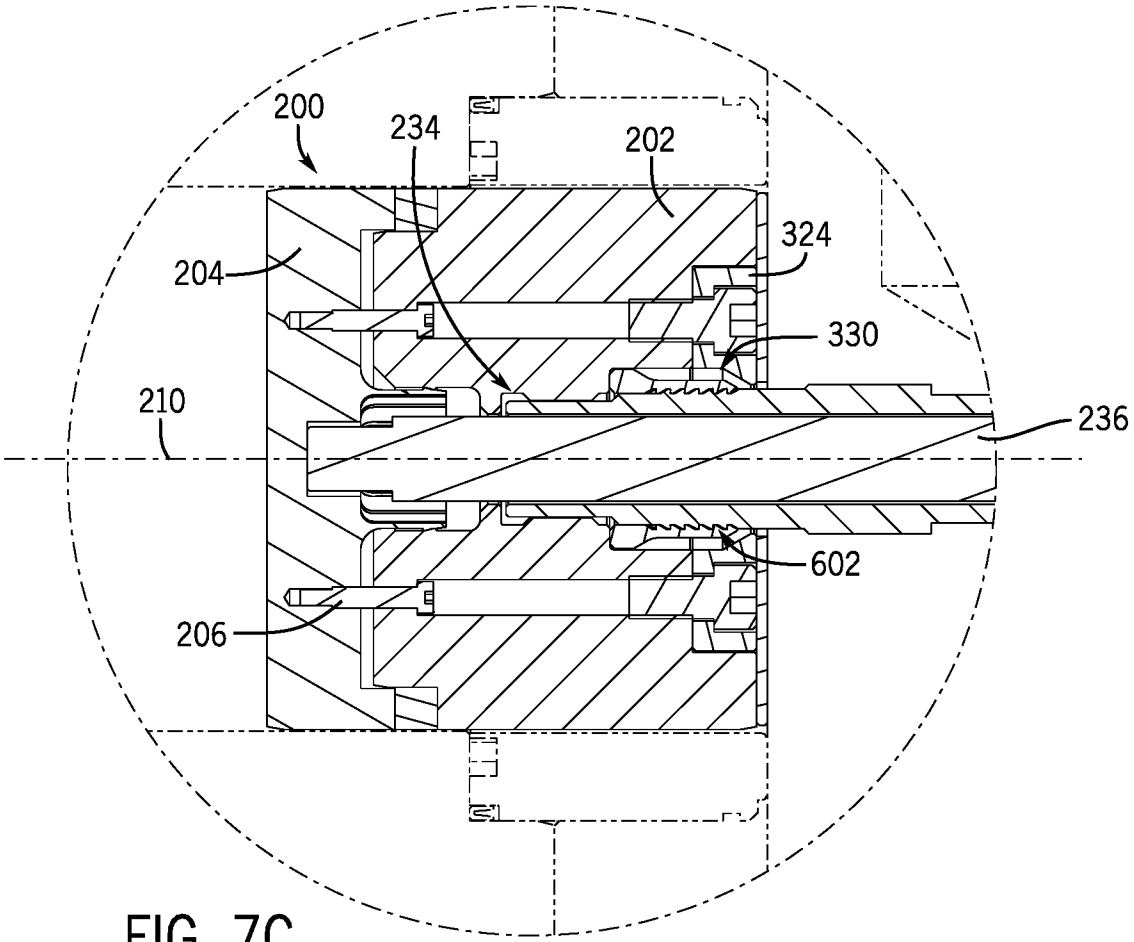
FIG. 7C is a cross-sectional view of an embodiment of a pressure boundary tool coupled to a retrieval end, in accordance with embodiments of the present disclosure.

FIG. 7C is a cross-sectional view of the pressure boundary tool 200 where the retrieval end 234 is coupled to the collet assembly 330. As shown, the retrieval end 234 includes the grooves 602 along the sleeve 244 that mate with the collet 330. The sleeve 244 may be pulled such that the collet 330 is driven against the capture plate 324. However, due to the capture plate 324, the force may be transmitted to the plug body 202, which further carries the plate 204 out of the flow passage 304 due to the connections at the fasteners 206. Accordingly, the tool 200 may be removed from the XT 102 in a configuration where threaded connections are used for installation, but not for removal.

Figure 8:
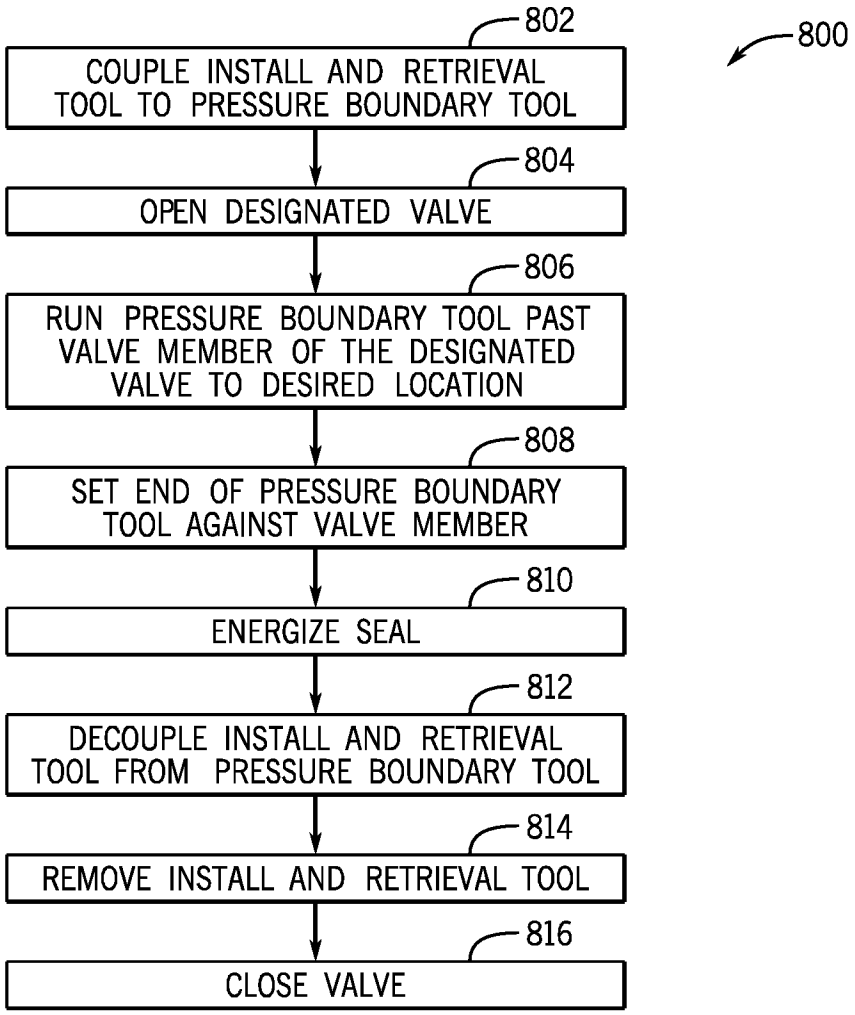
FIG. 8 is a flow chart of an embodiment of a process for setting a pressure boundary tool, in accordance with embodiments of the present disclosure.

FIG. 8 is a flow chart of an embodiment of a process 800 for setting a pressure boundary tool. It should be appreciated that for this process, and all processes discussed herein, that there may be more or fewer steps. Additionally, the steps may be performed in a different order, or in parallel, unless otherwise explicitly stated. In this example, an install and retrieval tool is coupled to a pressure boundary tool 802. For example, the install end 232 may be coupled to the plate 204 and the sleeve 244 may be coupled to the plug body 202. In at least one embodiment, the coupling is performed via one or more threaded connections, but it should be appreciated that other coupling methods may be utilized within the scope of the present disclosure.

The pressure boundary tool may be set for installation at a designated location within wellbore system, such as the XT 102, and an associated value may be opened 804. In at least one embodiment, the valve may be a gate valve, where a gate may be removed from a flow passage to permit passage of the pressure boundary tool. The pressure boundary tool may be run past a valve member to a desired location 806. For example, the pressure boundary tool may be tripped through the XT 102 to position the pressure boundary tool on a downstream side of the valve member 306. The location of the pressure boundary tool may be determined based, at least in part, on a valve body position with respect to a valve seat 314, where certain embodiments may particularly select locations past valve seats 314 as sealing surfaces for the seal 208.

The pressure boundary tool may be set against the valve member 808. For example, a plug body 202 may be pulled against the valve member 306 such that a disk 316 engages the valve member 306. As noted, the disk 316 may be a soft material in order to prevent damage to the valve member 306. The seal may then be energized 810. For example, the plate 204 may be driven toward the plug body 202, such as via rotation of a nut 246 to drive movement of an associated shaft 236. The movement of the plate 204 may reduce or collapse a gap 318 between the plate 204 and the plug body 202, thereby compressing the seal 208 outwardly and against the valve body 302.

When the seal is set, the installation and retrieval tool may be decoupled from the pressure boundary tool 812. For example, one or more threaded connections may be reversed or broken, where certain embodiments may include anti-rotation pins to facilitate the decoupling. The installation and retrieval tool may then be removed 814 and the valve may be closed 816. In this manner, a secondary pressure boundary is positioned within the XT 102.

Figure 9:
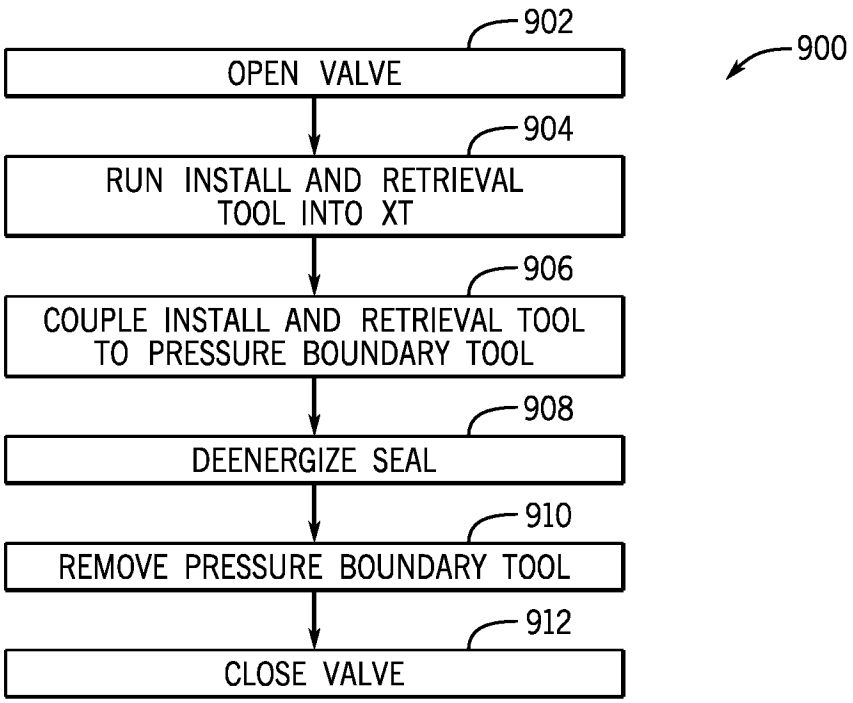
FIG. 9 is a flow chart of an embodiment of a process for retrieving a pressure boundary tool, in accordance with embodiments of the present disclosure.

FIG. 9 is a flow chart of an embodiment of a process 900 for removing a pressure boundary tool. In this example, a valve is opened 902. The valve may be associated with a setting location of the pressure boundary tool. An installation and retrieval tool is then run into the XT 904 and coupled to the pressure boundary tool 906. For example, the installation and retrieval tool 230 may include the retrieval end 234. In various embodiments, the retrieval end 234 does not include threads and may engage the collet assembly 330 within the plug body 202. The seal may then be deenergized 908. For example, a force may be applied to the plate 204 such that the plate 204 is moved away from the plug body 202 to at least partially restore the gap 318. The pressure boundary tool may then be removed 910 and the valve may be closed 912.

The foregoing disclosure and description of the disclosed embodiments is illustrative and explanatory of the embodiments of the disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A system, comprising:

pressure boundary tool, comprising:

a plug body, the plug body having an orifice extending from a first end to second end;

a plate coupled to the second end via one or more fasteners, the plate positioned for axial movement along an axis of the pressure boundary tool;

a seal arranged within a seal groove formed between the plug body and the plate;

a retaining assembly positioned at the second end within the orifice; and a capture plate arranged over the retaining assembly to maintain a position of the retaining assembly within the orifice; and an installation and retrieval tool, comprising:

a shaft having first threads on a first shaft end and being non-threaded at a second shaft end, the threads configured to engage mating threads of the plate; and a sleeve having second threads on a first sleeve end and couplers on a second sleeve end, the second threads configured to engage the plug body and the couplers configured to engage the retaining assembly;

wherein the first threads and the second threads are configured for use during an installation process and the couplers are configured for use during a retrieval process.

2. The system of claim 1, further comprising:

a nut associated with the installation and retrieval tool, the nut configured to drive movement the shaft along the axis to move the plate toward the plug body to energize the seal.

3. The system of claim 1, further comprising;

a disk arranged over the capture plate.

4. The system of claim 1, further comprising:

a piston configured to couple to the first threads during the removal process, the piston to apply a force to drive the plate away from the plug body and deenergize the seal.

5. The system of claim 1, wherein the capture plate is coupled to the plug body via one or more second fasteners.

6. The system of claim 5, wherein the one or more second fasteners are within a common passage as the one or more fasteners.

7. The system of claim 1, further comprising:

extensions formed on the plate, the extensions to be aligned with the seal such that movement of the plate toward the plug body drives the extensions into the seal groove.

8. The system of claim 1, wherein the retaining assembly is a collet and the collet engages the couplers during the retrieval process.

9. The system of claim 1, wherein the pressure boundary tool is positioned downstream of a valve member such that the seal engages a valve body.

10. A system, comprising:

a Christmas tree (XT) having at least one valve, the XT being coupled to a wellbore;

a pressure boundary tool adapted to provide a secondary boundary for the XT, the pressure boundary tool comprising:

a plug body to be positioned against a valve member of the at least one valve;

a seal to be energized into a valve body of the at least one valve; and a plate arranged proximate the seal, the plate being moveable between a first position and a second position, the first position energizing the seal and a second position deenergizing the seal;

wherein the pressure boundary tool is positioned within the XT on a side of the valve member closer to the wellbore.

11. The system of claim 10, further comprising:

an installation and retrieval tool associated with the pressure boundary tool, the installation and retrieval tool having a first end that couples to both the plug body and the plate during an installation process and a second end that couples to a retaining component of the plug body during a removal operation.

12. The system of claim 10, further comprising:

a disk positioned along an end of the plug body proximate the valve member, the disk being formed of a material that is softer than the valve member.

13. The system of claim 10, wherein threaded fittings are used during installation and energizing of the pressure boundary tool and non-threaded fittings are used during deenergizing and removal of the pressure boundary tool.

14. The system of claim 10, wherein a plug body length is greater than a valve seat length.

15. The system of claim 10, further comprising:

an installation and retrieval tool having a shaft and a sleeve, wherein rotation of the shaft, driven by a nut, drives movement of the plate from the second position to the first position.

16. The system of claim 10, further comprising:

a collet positioned within an orifice of the plug body, the collet being maintained within the orifice via a capture plate, wherein the collet engages grooves of an installation and retrieval tool when the pressure boundary tool is being removed.

17. A method, comprising:

coupling an installation and retrieval tool to a pressure boundary tool;

opening a specified valve of a Christmas tree (XT);

running the pressure boundary tool past a valve member of the specified valve;

energizing a seal of the pressure boundary tool;

decoupling the installation and retrieval tool from the pressure boundary tool;

removing the installation and retrieval tool from a flow passage of the specified valve; and closing the specified valve.

18. The method of claim 17, further comprising:

reopening the specified valve;

running the installation and retrieval tool to the pressure boundary tool;

engaging a retaining assembly within the pressure boundary tool;

deenergizing the seal; and removing the pressure boundary tool from the XT.

19. The method of claim 18, wherein deenergizing the seal comprises:

applying a force to a plate of the pressure boundary tool.

20. The method of claim 17, wherein energizing the pressure boundary tool comprises:

moving a plate in an uphole direction toward a plug body to compress the seal.

* * * * *